US005506033A

United States Patent [19]

Smith

[11] Patent Number: 5,506,033

[45] Date of Patent: Apr. 9, 1996

[54] DRYER FABRIC EDGE SEAL

[75] Inventor: Richard W. Smith, Greenville, S.C.

[73] Assignee: Wangner Systems Corporation, Greenville, S.C.

[21] Appl. No.: 239,903

[22] Filed: May 9, 1994

Related U.S. Application Data

[63] Continuation-in-part of Ser. No. 43,848, Apr. 7, 1993, abandoned.

[51] Int. Cl.[6] ..... B32B 23/02

[52] U.S. Cl. ..... 428/192; 428/222; 428/227; 428/236; 428/280; 162/348

[58] Field of Search ..... 428/192, 222, 428/226, 227, 229, 236, 280, 282, 284; 162/348; 66/169 R; 68/20; 156/130.7, 157

[56] References Cited

U.S. PATENT DOCUMENTS

| | | | |
|---|---|---|---|
| 4,500,590 | 2/1985 | Smith | 428/222 |
| 4,528,236 | 7/1985 | Fury et al. | 428/222 |
| 4,791,708 | 12/1988 | Smolens | 24/33 |
| 4,798,760 | 1/1989 | Diaz-Kotti | 428/234 |
| 4,915,896 | 4/1990 | Rachal | 264/511 |

*Primary Examiner*—Patrick J. Ryan
*Assistant Examiner*—Merrick Dixon
*Attorney, Agent, or Firm*—Henry S. Jaudon; Cort Flint

[57] ABSTRACT

A dryer fabric for use with a dryer section of a paper forming machine wherein a plurality of transversely extending pintles interconnect a plurality of transversely extending coils to form the dryer fabric as a continuous loop. The dryer fabric is stabilized and its edge portions are protected from wear by a U.V. silicone rubber which encapsulates end portions of the pintles and coils and forms a bead along outer surfaces of the dryer fabric. The dryer fabric is capable of operating at temperatures of between 350° to 500° F. in a paper forming machine without accelerated degradation.

6 Claims, 3 Drawing Sheets

DRYER FABRIC EDGE SEAL

This is a continuation-in-part of application Ser. No. 08/043,848 filed on Apr. 7, 1993 now abandoned.

BACKGROUND OF THE INVENTION

The instant invention is directed to papermaking fabrics for use in papermaking machines consisting of a paper forming section where a wet sheet is formed from a dilute suspension of cellulose fibers in water. The dilute fiber suspension of 0.2 to 1.0% solids is discharged at speeds up to 6000 ft./min. on to a moving forming fabric moving at the fiber discharge speed ±30 ft./min. As water is removed by suction throughout the permeable forming fabric, a paper sheet is formed on the surface of the forming fabric by a process of filtration and reorientation of suspended fibers to a plane parallel with the plane of the forming fabric surface. The consistency is further increased by additional water removal by suction until it reaches a consistency of 20–25% solids.

At that point, the wet paper sheet has sufficient wet strength to be transferred to the press section where the wet paper sheet is further dewatered by pressing the wet sheet between a smooth roll and a woven or needled papermakers wet felt. In the process of pressing, water is transferred from the wet paper sheet to the papermaker's felt, which is so constructed that it retains the necessary void volume under pressure to pass the water expressed from the wet paper sheet.

Through a series of such presses, the wet paper sheet is subject to increasing pressure and the solid content of the paper will increase from 20–25% to 37–45% depending on paper, grade, machine speed and press construction.

With present technology, 47% solids appear to be the maximum solids content in a sheet of paper that can be obtained through pressing.

After the press section, the paper sheet is transferred to the drying section where the rest of the moisture in the pressed sheet of paper is removed by evaporation in the following manner. First, the paper sheet is brought in contact with the hot surface of a series of rotating steam heated cylinders. These dryer fabrics are made from polymeric material and can be either woven fabric, spiral fabric or other fabric construction. These fabrics are made endless by a cross machine direction seam during installation. The edges of the fabric are subject to damage and wear due to contact with stationery machine parts and guide pedals. It is therefore imperative that the fabric edges be protected. The subject of this invention is an edge coating for a dryer fabric of polymeric material which is degradation resistance and the method for applying this coating.

Dryer fabrics are subject to thermal and chemical degradation by hydrolysis on the paper machines. This degradation is produced by the high temperatures of between 320° F. to 350° F. and high humidity of 0.25 to 0.35 lb. of water per pound of dry air to which it is subjected in use. It is essential that the treatment of the edges of the dryer fabric have a resistance to thermal degradation and degradation by hydrolysis that exceeds that of the polymeric material forming the dryer fabric.

It is usual that dryer fabrics have a sealer coating applied to their edges in order to protect them against wear and prevent unraveling. Sealed edges also act to stabilize the entire dryer fabric against yarn shifts which render the drainage channels uneven when the fabric is in use.

The most common coatings employed as an edge seal are polyurethane and epoxies polyurethanes. These materials have the capability of securely adhering to the monofilaments forming the dryer fabric and they possess good degradation resistance to most of the chemicals employed with papermaking machines in the papermaking process. It has been found, however, that these coatings are not sufficiently degradation resistant for use with dryer fabrics formed of polyphenylene sulfide, polypropylene terephtalate and others which have a useful life of between 300 and 400 days on the paper machine.

A second problem with the current coating materials as an edge seal coating is the cost of application. These materials, when applied as a liquid to the fabric edge, require between twenty minutes and twenty four hours to dry completely. The coating process normally takes place on a circular fabric, which is carried by a pair of drive rolls under tension. Due to the drying time required, the coated edges are passed over the rolls in a partially dried state. In this state, the coating material attaches to the drive rolls. The coating material on the rolls tend to stick with the coating on the fabric edges to produce an uneven bead along the fabric edge. Eventually these attached coatings lead to degradation of the edge seal.

To eliminate this attaching, the drive rolls must be covered with tape at the edge portions of the fabric. The tape is of a material to which the coating material does not readily adhere. This process improves the procedure, but eventually the coating material builds up and the above problems are encountered.

Numerous attempts have been made to find a more satisfactory edge seal coating as indicated by the below referred to U.S. Patents.

U.S. Pat. No. 2,718,791 to Hose et al show one such attempt. Here, the edge portions of a Fourdrinier belt are coated with a polyethylene material which is flexible and elastic. Polyethylene degrades at around 300° F.

U.S. Pat. No. 3,523,867 to MacBean discloses a sealed coated edge for a paper forming fabric similar to the Hose et al patent. MacBean employs nylon, polyethylene or polyvinylchloride as the coating material. The fabric of this patent encounters similar problems to those discussed above.

U.S. Pat. No. 3,652,390 to Peterson is also directed to an edge seal coating for a paper forming fabric. Here the edges are coated with polyethylene or rubber.

None of the patents discussed provide a solution for the deficiencies as set forth above.

Accordingly, it is an object of the invention to provide a stable coil constructed dryer fabric for paper forming machines.

Another object of the invention is to provide a dryer fabric capable of operating at temperatures of between 320° and 350° F.

Another object of the invention is to provide an edge seal coating which protects the fabric forming yarns forms the fabric edge and prevents wear and maintains stability.

Another object of the invention is to provide a novel method of coating the edges of dryer fabrics formed of coiled filaments.

Another object of the invention is to provide a method of edge coating and drying a forming fabric between fabric carrying rolls.

Another object of the invention is to provide a more cost efficient method of edge coating a dryer fabric.

Another object of the invention is to provide a polymer paste which may be polymerized into a non-tacky condition immediately after application to the edge portions of a dryer fabric.

SUMMARY OF THE INVENTION

The invention relates to dryer fabrics which are capable of operating at temperatures of between 320° and 350° F. in a dryer section of a papermaking machine. One such fabric is formed of a plurality of transversely extending coiled monofilament yarns which are interconnected with a plurality of transversely extending monofilament pintles. The yarns and pintles are preferably formed of polyaryletherketone polymers PEEK, polyphenylene sulfide, RYTON, or other similar heat resistant, moisture resistant filaments. The end portions of the pintles and yarns are fused together and the dryer fabric is formed as a continuous loop having a support surface and a running surface.

The dryer fabric includes an edge coating of a non-flowing U.V. silicone paste which is adhered to and along each of its edge portions. The U.V. silicone coating forms a continuous bead along both the support surface and the running surface. It also extends through the interstices of the dryer fabric to unite the coils with the pintles at the edge portions. This arrangement produces a stable dryer fabric in which the edge portions are protected from wear.

The U.V. silicone paste comprises a mixture of polydimethylsiloxane, modified silicon dioxide, and ethyltriacetoxysilane which is commercially sold as NUVA-SIL 83 U.V. curing silicone. This silicone paste has the capacity to be polymerized into a solid non-tacky substance immediately after application by the radiation of an ultra violet light.

The application of the U.V. silicone paste is carried out on both sides of the fabric under pressure to ensure that the silicone polymer penetrates the fabric from both sides ensuring that a solid bonding to the fabric is effected.

The invention also relates to a method of producing a stable dryer fabric for use with a papermaking machine which includes the steps of; forming a continuous fabric of interconnected transversely extending synthetic monofilament coils and pintles; placing the continuous fabric about spaced drive rolls and applying tension to the continuous fabric; rotating the tensioned continuous fabric about the drive rolls; applying a U.V. silicone rubber paste to edge portions of the tensioned and rotating fabric at a location between the drive rolls; drying the U.V. silicone paste to a solid state intermediate of the drive rolls; and removing the continuous fabric from the drive rolls.

The continuous fabric may be heat set at between 400° and 500° F. prior to applying said coating. The continuous fabric is tensioned between the drive rolls until it is taught. The fabric is then rotated about the drive rolls at between 6 and 12 meters per minute and the U.V. silicone paste is applied under pressure of between 50 and 150 PSI simultaneously to both the upper and the lower edge surfaces of the continuous fabric to form a bead on each of these surfaces and to completely fill the interstices of the fabric along the edge portions.

The coated dryer fabric is passed immediately through ultra violet light of between 250 and 350 watts per inch. The ultra violet light acts to dry the U.V. silicone paste substantially instantaneously while the fabric is still between the drive rolls.

Prior to coating, the edge portions of the continuous fabric are cut to form the fabric to a desired width with heat cutters which also act to melt bond the coils and pintles together at the point of cutting.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 2:
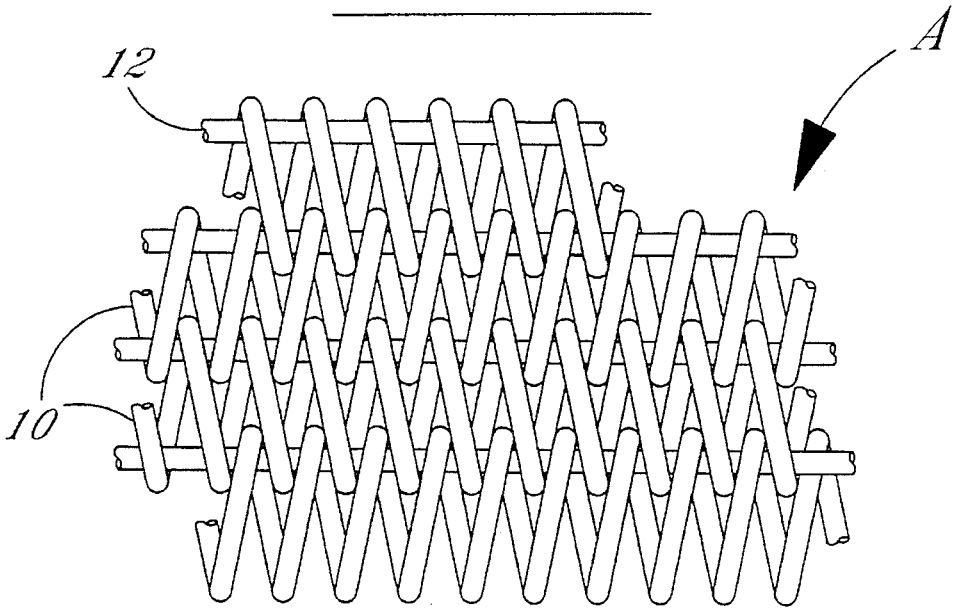
FIG. 2 is a detailed sectional top view showing the coil, pintle fabric construction.
Figure 7:
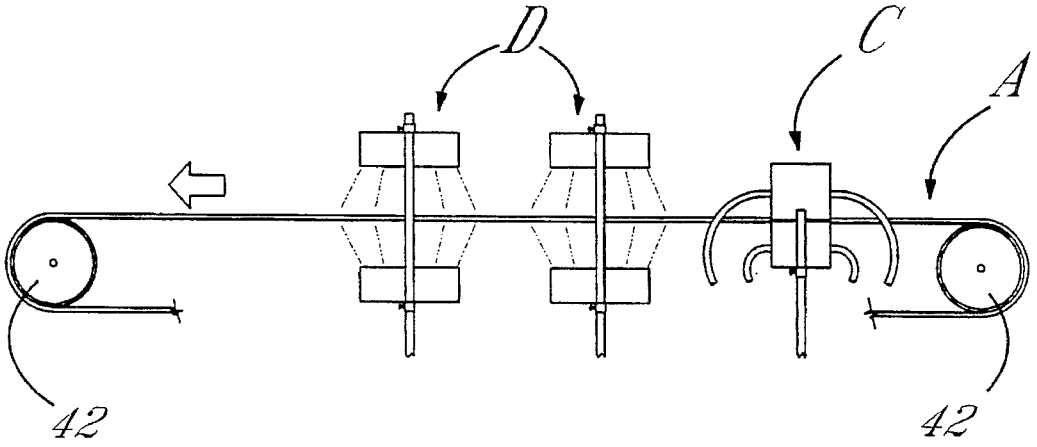
FIG. 7 is a side view of the coating and drying arrangement according to the invention.

Turning now to the drawings, FIG. 2 shows in detail the structure of dryer fabric A which is formed of transversely extending coils formed of monofilaments 10 which are interconnected by transversely extending pintles 12. Dryer fabric A is constructed as a continuous loop as shown in FIG. 7. Coil forming monofilaments 10 are preferably formed of heat resistant polyaryletherketone polymers such as RYTON. Monofilaments 10 forming the coils may be circular or rectangular in cross-section. The circular monofilaments have a major axis measurement of between 0.3 mm to 1.3 mm. The rectangular monofilaments have a flatness ratio of between 1.1:1 and 2.5:1.

Modern dryer sections operate at temperatures of between 320° F. and 350° F. These fabrics have a permeability factor of between 600 and 1000 CFM. During operation, the water content of the paper slurry is reduced from 50% to 60% to approximately 2% in a very short time over a limited area. Because of the limited area and high temperatures there is a large build up of steam and humidity; between 0.25 and 0.35 lb. of water per pound of dry air. This necessitates that the dryer fabric, to include its edge coating, have a high hydrolysis resistance and chemical resistance in order that it may possess satisfactory degradation properties.

It is extremely important that dryer fabrics be stable in operation. It is necessary that the coil filaments not shift and that the edges not fray or unravel. To this end pintles 12 may be crimped at the points where coil filaments 10 engage therewith. This structure is described in more detail in U.S. Pat. No. 5,104,724, the disclosure of which is incorporated herewith. It is also usual that the edge structures are sealed as shown at 14 in FIGS. 1, 4 and 6 by cutting the fabric to width with a heat cutter. This cutting apparatus causes the end portion of the coil forming filaments 10 to fuse with pintles 12 where they contact. It is also usual to further stabilize the drying fabrics by applying an edge seal which consist of coating the edge portions with a synthetic material. The usual synthetic material is a polyester resin.

For modern dryer fabrics this structure presents two major obstacles. Primarily, the usual edge coatings such as polyesters and epoxy polyurethanes begin to degrade at temperatures of around 300° F. Due to the high operating temperatures of the modern dryer machines, as already discussed, these coatings degrade quickly and the fabric is rendered unstable and must be replaced.

A second drawback of forming edge seals is the drying time of the sealant. Known polyurethanes and epoxy polyurethanes require approximately twenty minutes to dry. As the coatings are applied to endless fabrics passing over support rolls such as rolls 42 shown in FIG. 7, the un-dried sealant attaches to the rolls. As the sealant paste builds upon the rolls, it tends to disrupt the uniformity of the coating applied to the edges to the point than it tends to pull the coating from the fabric. This produces an uneven edge seal and in some instances an unstable edge seal. In order to alleviate this problem the rolls must be covered with a material, usually paper, which does not readily adhere with the coating material. This is a labor intensive and time consuming operation. Also, it is only a temporary solution as the sealant eventually builds up on the paper and the above referred to problems are incurred.

A previously unused coating sealant in papermaking, i.e, silicone rubber, has been found to be extremely satisfactory. This sealant, when dried, retains its flexibility, does not appreciably degrade when subjected to the chemicals (principally chlorine) used in papermaking and functions in a temperature range of between −85° and 400° F. Silicone rubber sealants have been found to adhere with synthetic materials such as those formed of PEEK and RYTON.

There are three basic categories of silicone rubber sealants available. They may be categorized by the manner in which they are cured.

The most commonly available type of silicone rubber sealant are those which are cured by exposure to atmospheric moisture or to air. They are cured by irradiation. One such silicone rubber sealant is RTV Sealant 732 manufactured by Dow Corning. This sealant requires at least five minutes to skin over and at least twenty four hours to completely cure.

Another type of silicone rubber sealant is cured by exposure to heat. Such a sealant is applied in paste form and then is cured by the application of heat. Again the curing time is several minutes. Also, the heating process could effect the heat set of a heat set fabric to which this sealant is applied.

Basic ingredients for these type of silicone rubber sealants are silica, amorphous, fumed, methyltriacetoxysilane, ethyltriacetoxysilane, dimethylsiloxane and hydroxy terminated. Neither of these categories of sealants, when used as an edge coating for paper making fabrics, eliminate the problem of build-up on the rolls supporting the continuous paper forming fabric during its application onto the fabric edges.

A third category of silicone rubber sealant is one which cures when subjected to ultra violet radiation. This silicone sealant is described as an ultra violet curable silicone, a UV/ACETOXY Curing Silicone or a UV SILICONE sealant. To date, there is only one known manufacturer of such a silicone sealant and that is the Foctite Corporation of Newington, Conn. The product is sold under the name NUVA-SIL 83 and is described as a U.V. CURING silicone sealant. This U.V. CURING silicone sealant possesses cure properties which when subject to ultra violet radiation of between 75 and 250 mW/cm$^2$ becomes completely tack-free in less than two seconds.

NUVA-SIL 83 silicone coating, when applied to the edges of a dryer fabric, does not decompose when subjected to the operating temperatures of the modern dryer machines. Also, when applied to the edges of a dryer fabric in the manner depicted in FIGS. 6 and 7, the edge seal fully adheres with the fabric and is completely dried prior to reaching the down stream support roll 42 and the bead of the seal is uniform throughout its length.

NUVA-SIL 83 includes between 60 and 65% Poly (dimethylsiloxane) hydroxy terminated, between 20–25% modified silicone dioxide, between 5 and 10% poly (dimethylsiloxane) Dimethyl polysilosiloxane and between 3–5% modified triacetoxysilane. Lesser amounts of photoinitiator (1–3%) and Ethyetriacetoxysilane, Methyltriacetoxysilane, and Dibutyltin dilaurate (0.1–1%) may be included.

The term U.V. Silicone rubber, paste or sealant is herein defined as describing a silicone sealant which is formulated to cure when subjected to a prescribed level of ultra violet radiation.

Figure 1:
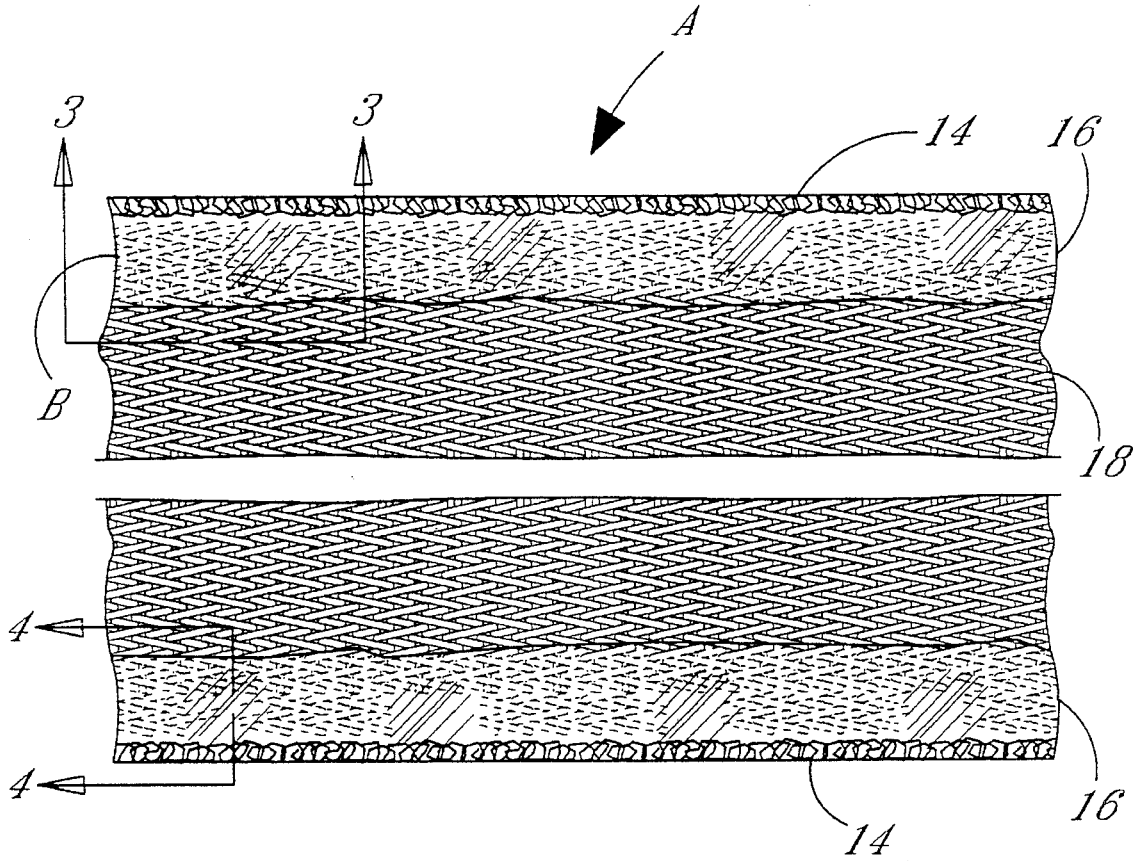
FIG. 1 is a sectional top view of the dryer fabric having an edge seal on each edge thereof.
Figure 3:
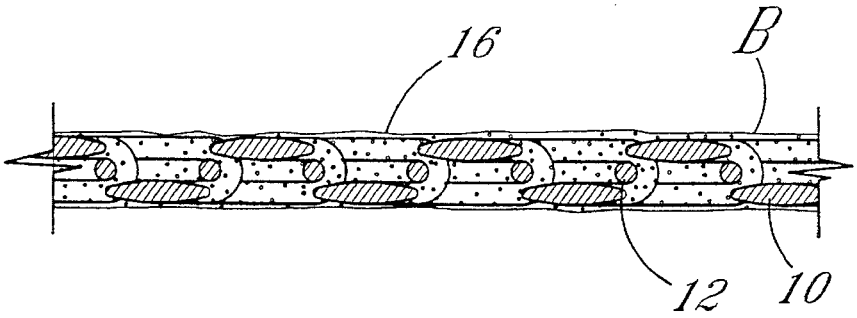
FIG. 3 is a sectional side view showing the sealed edge structure of the dryer fabric taken along lines 3—3 of FIG. 1.
Figure 4:
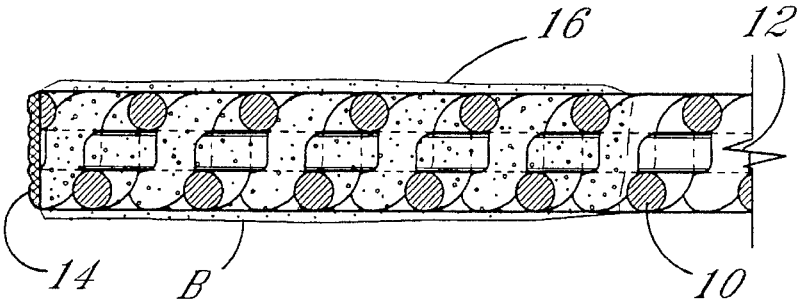
FIG. 4 is a sectional end view similar to FIG. 3 taken along lines 4—4 of FIG. 1.
Figure 5:
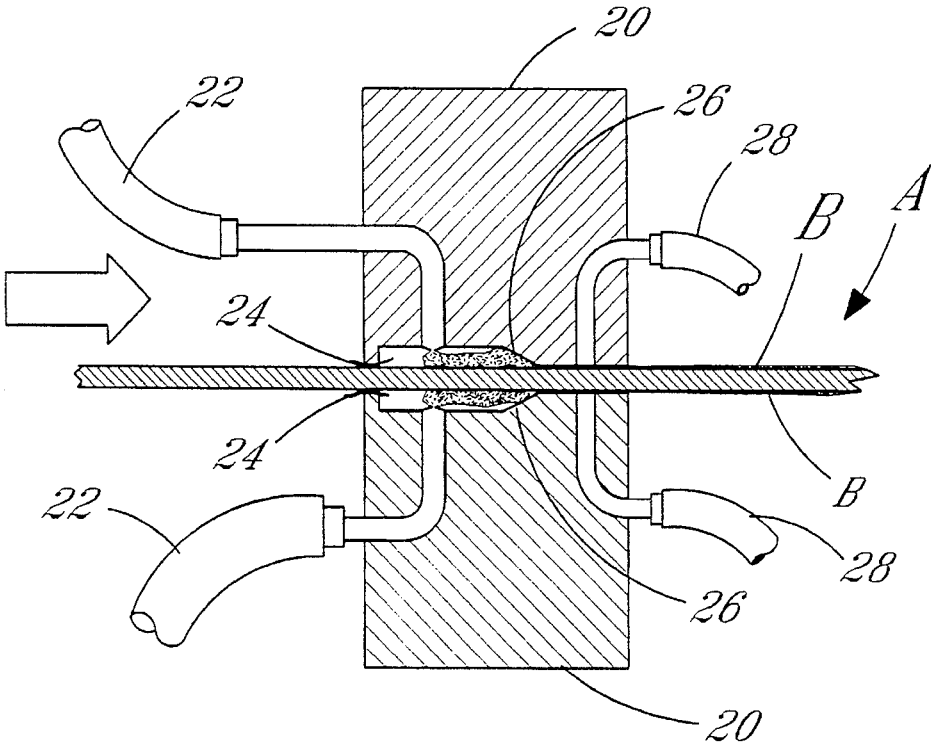
FIG. 5 is a sectional side view of the coating heads taken along lines 5—5 of FIG. 6.

Referring to FIG. 1, dryer fabric A of the invention is shown with a central support area 18 which is uncoated and porous. Edge portions 16 are shown as sealed with U.V. silicone paste B which, when cured, encapsulates end portions of both the coil forming monofilaments 10 and monofilaments or pintles 12 to unite them together and to protect them from wear thereby forming a stable edge seal. Edge portions 16 are further stabilized as the end most portions of the monofilaments 10 and pintles or monofilaments 12 are fused together forming fused edge 14. The silicone coating B also encapsulates and stabilizes the fused edge 14. Coating B which forms the edge seal extends inwardly for between ½" and 2" from the fused edge 14. Coating B passes completely through forming fabric A as best shown in FIGS. 3 and 4 to form a protective covering on both the support surface and the running surface of edges 16.

Figure 6:
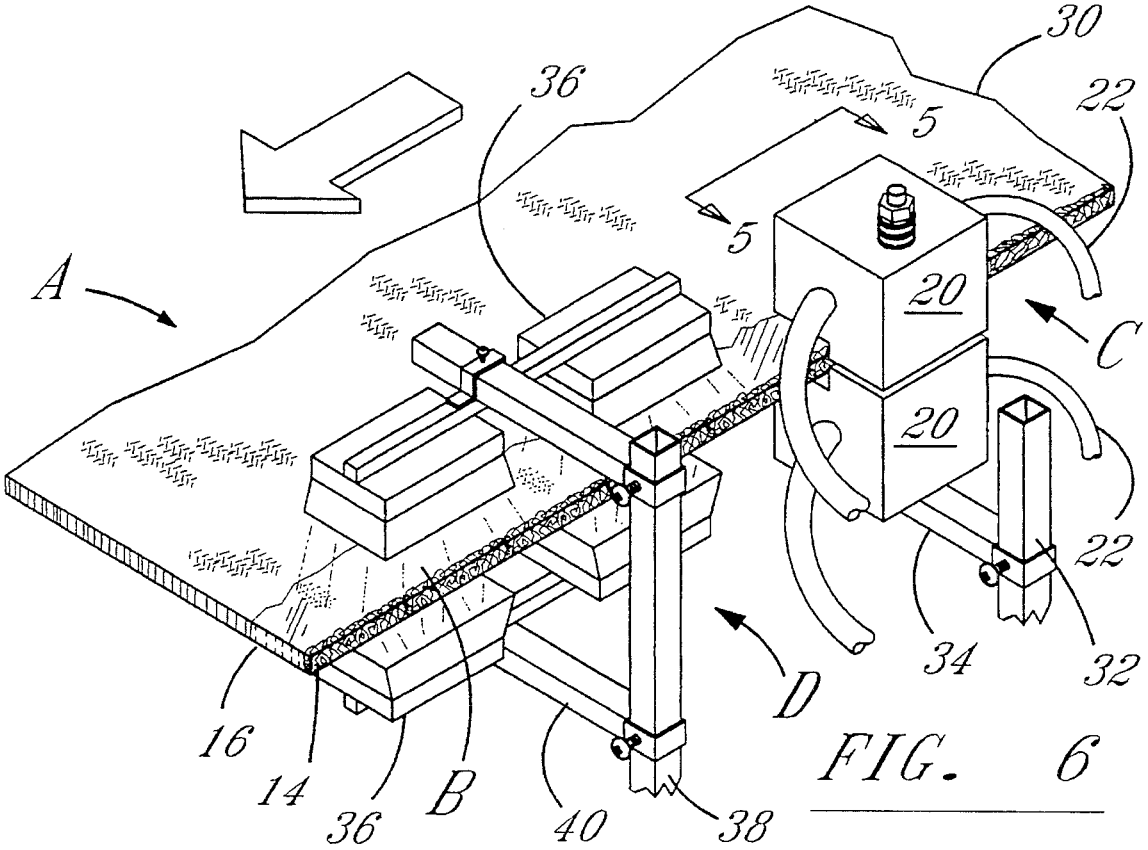
FIG. 6 is a perspective view of the coating and drying arrangement according to the invention.

As shown in FIGS. 6 and 7, dryer fabric A, which is a continuous fabric, is passed through coating apparatus C and drying apparatus D by drive rolls 42. Drive rolls 42 are adjustably spaced so that dryer fabric A is brought under tension while passing through the coating apparatus C and dryer D. Dryer fabric A is tensioned until taught which is somewhere around 40 lbs. per linear inch.

The U.V. silicone paste is applied at room temperature to the fabric edge 16 under pressure by means of coating heads 20. The silicone paste is supplied to heads 20 by lines 22 under a pressure of between 50 PSI and 100 PSI. The silicone paste is delivered into a chamber 24 formed in each head 20. The forward end of chamber 24 which is includes a pair of ramps 26 which force the silicone paste over the outer surfaces and into the interstices of fabric A. Waste removal hoses 28 are arranged downstream of ramps 26 to receive and draw off excess silicone. Coating heads 20 are compressed together to a controlled degree by adjustable resilient means 30.

Vertical rod 32 and horizontal rod 34 support coating heads adjacent edge position 16 of dryer fabric A. Heads 20 are adjustable vertically of rod 32 by adjusting the clamp connecting rod 34 with the vertical rod. Heads 20 are similarly adjustable relative to rod 34.

As dryer fabric A emerges from coating heads 20 it is immediately passed beneath dryer D. The dryer consists of a plurality of ultra violet lamps 36. Preferably there are two banks of these ultra violet lamps arranged at between 4 and 6 inches above and below edges 16 of dryer fabric A.

Each ultra violet lamp 36 delivers approximately 300 watts per inch. The lamps 36 are mounted by horizontal arms 40 which are carried by vertical rod 38. Lamps 36 are vertically and horizontally adjustable in a usual manner as shown in FIG. 6 and as described for coating heads 20.

Dryer fabric A is carried by drive rolls 42 at a rate of between 6 and 12 meters per minute through coating apparatus C and drying apparatus D. The coating of U.V. silicone paste is completely dry prior to fabric A reaching down stream drive roll 42

In an alternative arrangement, the dryer fabric could be constructed as a woven double or triple layer fabric with the warp and/or weft being formed of mono or multi filament yarns extruded from PEEK, RYTON, or other similar heat resistant materials. The dryer fabric may be woven endless or made endless after weaving.

While a preferred embodiment of the invention has been described using specific terms, such description is for illustrative purposes only, and it is to be understood that changes and variations may be made without departing from the spirit or scope of the following claims.

What is claimed is:

1. A dryer fabric capable of operating at temperatures of between 320° and 350° F. in a dryer section of a papermaking machine including a plurality of transversely extending coiled monofilament yarns interconnected with a plurality of transversely extending monofilament pintles forming said dryer fabric as a continuous loop having a support surface and a running surface, the improvement comprising;

a pair of continuous edge sealing strips formed along opposite edges of said dryer fabric, said strips comprising a U.V. silicone sealant adhered to each edge portion, said U.V. silicone sealant forming a coating comprising a continuous and uniform bead over said support surface and said running surface said bead extending through interstices of said dryer fabric to unite end portions of said coils with end portions of said pintles and to seal said edge portions; whereby, a dryer fabric is provided in which end portions of said coils and pintles are stabilized and protected from wear by a degradation resistant coating.

2. The dryer fabric of claim 1 wherein said monofiliment yarns and pintles are formed of polyaryletherketone polymers.

3. A dryer fabric having outer surfaces for use with a dryer section of a paper forming machine, said dryer fabric being formed continuous of a plurality a transversely extending pintle filaments of synthetic material interconnecting a plurality of transversely extending coil filaments of synthetic material, said dryer fabric having opposed ends of said coils and said pintle filaments fused together; the improvement comprising, a U.V. silicone coating disposed along opposed edges of said dryer fabric to form a bead on said outer surfaces and to encapsulate end portions of said pintle and said coil filaments to include said fused ends, said U.V. silicone coating occupying interstices of said dryer fabric at said edges and acting to stabilize and protect said edges of said dryer fabric;

said synthetic filaments and said U.V. silicone coating being capable of operating at temperatures above 300° F. without substantial degradation.

4. The fabric of claim 3 wherein said U.V. silicone comprises between 60% and 65% polydimethylsiloxane and between 20% and 25% modified silicone dioxide.

5. The fabric of claim 3 wherein said filaments comprise monofilaments formed of polyaryletherketone polymers.

6. A dryer fabric capable of operating at temperatures of between 320° and 350° F. in a dryer section of a papermaking machine said fabric being formed of a plurality of monofilament yarns interconnected with a plurality of second monofilament yarns as a continuous loop having a support surface and a running surface;

said dryer fabric having a pair of continuous edge sealing strips formed along opposite edges thereof, said stripes comprising a U.V. silicone sealant adhered to each edge portion, said U.V. silicone sealant forming a coating comprising a continuous and uniform bead over and along said support surface and said running surface, said U.V. silicone sealant extending through interstices of said dryer fabric to unite end portions of said yarns with said second yarns and to seal said dryer fabric edge portions; whereby, a dryer fabric is provided in which portions of said yarns and second yarns are stabilized and protected from wear by a degradation resistant coating.

* * * * *